US009643335B2

(12) United States Patent
Hojnowski

(10) Patent No.: US 9,643,335 B2
(45) Date of Patent: May 9, 2017

(54) CONCRETE DISCHARGE BOOT ACCESSORY DEVICE AND METHOD OF USE THEREOF

(71) Applicant: Daniel J. Hojnowski, Birsdboro, PA (US)

(72) Inventor: Daniel J. Hojnowski, Birsdboro, PA (US)

( * ) Notice: Subject to any disclaimer, the term of this patent is extended or adjusted under 35 U.S.C. 154(b) by 120 days.

(21) Appl. No.: 14/147,848

(22) Filed: Jan. 6, 2014

(65) Prior Publication Data

US 2014/0119151 A1 May 1, 2014

Related U.S. Application Data

(63) Continuation of application No. 12/777,240, filed on May 10, 2010, now abandoned.

(60) Provisional application No. 61/176,687, filed on May 8, 2009.

(51) Int. Cl.
*B28C 5/00* (2006.01)
*B28C 5/42* (2006.01)

(52) U.S. Cl.
CPC ..... *B28C 5/00* (2013.01); *B28C 5/4244* (2013.01)

(58) Field of Classification Search
CPC ... B65G 11/026; B28C 5/4244; B28C 5/4248; B28C 5/4251; B28C 5/00
USPC ..... 366/44, 68; 193/4; 222/95, 105, 107
See application file for complete search history.

(56) References Cited

U.S. PATENT DOCUMENTS

| | | | | | |
|---|---|---|---|---|---|
| 700,799 | A * | 5/1902 | Mullan | 193/15 | |
| 889,906 | A * | 6/1908 | Claypoole | 298/7 | |
| 1,028,831 | A * | 6/1912 | Stagg | 193/4 | |
| 2,072,301 | A * | 3/1937 | Grayson | 366/45 | |
| 2,488,292 | A * | 11/1949 | Hilkemeier | B28C 5/4248 | 193/10 |
| 2,880,977 | A * | 4/1959 | Maxon, Jr. | B28C 5/4248 | 193/16 |
| 3,055,477 | A * | 9/1962 | Pastorius | 193/4 | |
| 3,097,677 | A * | 7/1963 | Mitchell | B65D 88/1637 | 141/317 |
| 3,190,423 | A * | 6/1965 | Wenning | 193/2 R | |
| 3,428,156 | A * | 2/1969 | Charyn et al. | 193/22 | |
| 3,627,090 | A * | 12/1971 | Dickey | 193/34 | |
| 3,789,897 | A * | 2/1974 | Saito | B65D 88/1618 | 222/105 |
| 3,930,567 | A * | 1/1976 | Sims | 193/10 | |
| 4,113,146 | A * | 9/1978 | Williamson | B65D 88/1618 | 222/105 |
| 4,573,204 | A * | 2/1986 | Polett | B65D 88/1668 | 222/105 |
| 4,917,266 | A * | 4/1990 | Kellenberger | B65D 88/1668 | 222/105 |

(Continued)

*Primary Examiner* — Abbas Rashid

(57) ABSTRACT

A cabling system and accessory for attachment to the rubber boot surrounding the metal chute area of either a front or rear loader concrete truck for improving and enhancing the function and purpose of the rubber boot and chute area of a ready mix concrete truck, and for increasing the safety, health, and environmental aspects of cleaning thereof, wherein physical exertion and risk of injury to the truck operator is minimized, wherein the quantity of water utilized for cleaning is reduced, wherein the overall cleanliness of the truck is improved, and wherein the functional life span of the boot, chute, mechanical parts, and the truck itself is increased.

6 Claims, 8 Drawing Sheets

(56) References Cited

U.S. PATENT DOCUMENTS

| | | | | | |
|---|---|---|---|---|---|
| 5,339,872 | A * | 8/1994 | Marino | B65F 1/0006 | 137/312 |
| 5,340,218 | A * | 8/1994 | Cuthbertson | B65D 88/1681 | 206/600 |
| 5,344,048 | A * | 9/1994 | Bonerb | B65B 69/0075 | 222/105 |
| 5,344,109 | A * | 9/1994 | Hokoana, Jr. | 248/100 | |
| 5,354,128 | A * | 10/1994 | Lewis | 366/68 | |
| 5,605,398 | A * | 2/1997 | Cronquist | 366/68 | |
| 5,636,764 | A * | 6/1997 | Bonerb | B65B 69/0075 | 222/105 |
| 5,927,461 | A * | 7/1999 | Jamieson | 193/6 | |
| 5,967,579 | A * | 10/1999 | Hebert | B65D 88/1618 | 222/105 |
| 6,019,243 | A * | 2/2000 | Marino | B65D 90/24 | 220/573 |
| 6,350,051 | B1 * | 2/2002 | Cain | B28C 5/4234 | 193/10 |
| 6,799,808 | B1 * | 10/2004 | Walters | 298/1 SG | |
| 6,874,309 | B1 * | 4/2005 | Bellis, Jr. | 56/320.2 | |
| 8,113,220 | B2 * | 2/2012 | Inglese | B28B 7/06 | 134/104.1 |
| 2002/0001255 | A1 * | 1/2002 | Flood et al. | 366/8 | |
| 2002/0189916 | A1 * | 12/2002 | Cole | 193/4 | |
| 2006/0000490 | A1 * | 1/2006 | Barragan et al. | 134/10 | |
| 2008/0251471 | A1 * | 10/2008 | Inglese | 210/800 | |

* cited by examiner

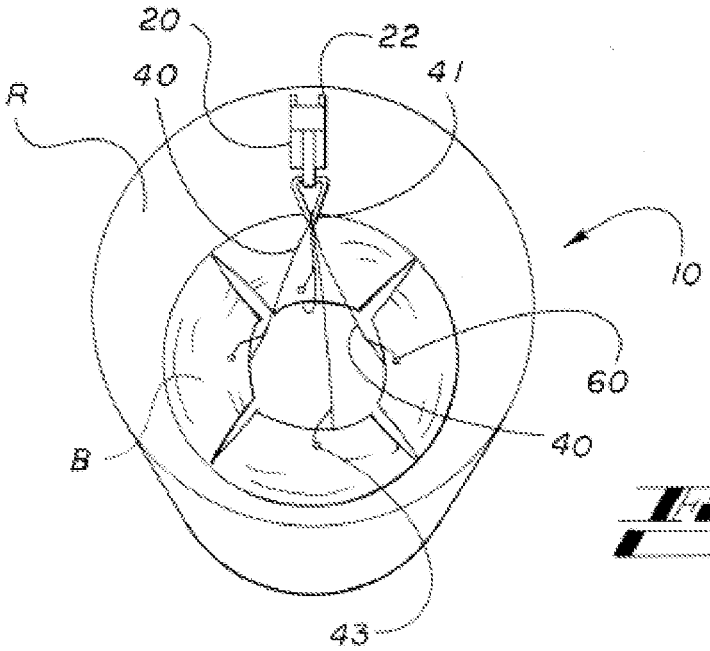
Fig. 2
Fig. 3
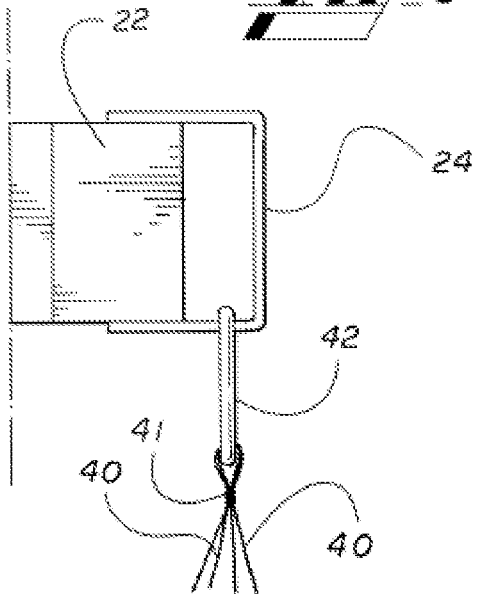

CONCRETE DISCHARGE BOOT ACCESSORY DEVICE AND METHOD OF USE THEREOF

CROSS REFERENCE TO RELATED APPLICATIONS

The present U.S. Non-Provisional patent application is a continuation application of currently pending U.S. patent application Ser. No. 12/777,240, filed May 10, 2010, which claims priority to and all benefit of U.S. Provisional Patent Application entitled "Concrete Discharge Boot Accessory Device and Method of Use Thereof," filed on May 8, 2010, on behalf of inventor Daniel J. Hojnowski, and having assigned Ser. No. 61/176,687.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF NON-LIMITING EXEMPLARY EMBODIMENT(S) OF THE PRESENT DISCLOSURE

Technical Field

The present disclosure relates generally to concrete delivery and ready mix concrete trucks, and more particularly, to an accessory for use with a concrete truck discharge boot for facilitating safe, efficient, and expeditious cleaning of the truck and chute area.

Background

Ready mix concrete trucks are expensive investments that yield a beneficial return over time, especially if operated and maintained in a manner to facilitate continued operation. That being said, it is recognizably well known that the inherent nature of concrete is to dry into a tough, non-yielding form on essentially any surface to which it is exposed. Thus, on a ready-mix concrete truck, over time, even small amounts of residue build one upon another, eventually leading to failure of components and even complete loss of operability for the mixing compartment itself.

Environmental concerns have led to the creation of numerous spill and splash guards, such as for adaptation to a dispensing chute, wherein such devices are generally directed toward protection of the area surrounding the chute. For example, shield style guards have been designed for utilization proximate the end of a dispensing chute in order to prevent unintended spillover. Such devices can be effective for their intended purpose; however, the level of realized protection for exposed truck surfaces is disadvantageously minimal.

A discharge boot, conversely, generally serves to protect and preserve the truck, as well as the immediately surrounding area from inadvertent spillage. Typically, the discharge boot is installed proximate the mixing drum and at the drop chute, wherein a plurality of interrelated and flexible flap members effectively funnel the ready-mix concrete from the drop chute to the dispensing chute. For the boot to maintain proper functionality, though, proper cleaning after each use is imperative. That is, without proper cleaning, concrete residue dries on the boot surfaces, as seen in FIG. 4, and hinders the flexible conformity to the chute contours. Over time and with improper cleaning, as additional residue builds, splashes of wet concrete escape to the surrounding environment, coat hydraulic fittings and couplings, as see in FIG. 5, and also land on painted surfaces of the truck, causing chipping and lending to functional failure, or at least to an overall poor appearance for the ready mix concrete truck.

Unfortunately, cleaning a discharge boot is a cumbersome and arduous task according to presently available methods. The truck operator must first typically access the dirty boot. Reaching up from the bottom is typically difficult, if not impossible, because the base of the drop chute is generally overhead and out of reach and climbing and/or standing on truck surfaces proximate thereto is a prohibited safety risk. In order to access the boot from above, it is necessary for the driver/operator to reach down into the drop chute. Since the extended length of the boot and the chute is greater than an individual reach range, a typical driver will utilize the handle of a hose nozzle to engage the edge of the boot, extending a length of hose down through the drop chute and boot. Because the boot is naturally wet at this stage, engagement is rendered even more difficult. Also, even when the boot is engaged, the driver must then twist and extend his body forward, bending over the drop chute to grasp the boot edge with his hand in order that he might manipulate the boot while spraying with water and washing there around.

Still further, the same manipulations must be completed at least one additional time in order to cleanse each side or flap of the boot. All of this time and effort, bending over, stretching and reaching can undoubtedly cause back injuries, headaches, musculoskeletal disorders (MSD's), and potentially dozens of other physical injuries as a result of the ergonomic risk factors that are caused, at least in part, by the awkward postures, repetitive twisting and bending.

Given the difficulty in accessing and cleaning the boot and surrounding area effectively, many ready-mix concrete truck operators become increasingly complacent and less diligent in boot cleaning efforts. This is coupled with the obvious safety risk presented by the necessary movements, and all in an industry that already has been recognized as having twice the rate of non-fatal, occupational injuries over general industry.

Therefore, it is readily apparent that there is a need for a boot accessory device that can facilitate effective and safe cleaning of a concrete discharge boot and related ready mix concrete truck, thereby avoiding the above-discussed disadvantages.

BRIEF SUMMARY

Briefly described, in a preferred embodiment, the present device overcomes the above-mentioned disadvantages, and meets the recognized need for such a device, by providing a cabling system and accessory for attachment to the rubber boot surrounding the metal chute area of either a front or rear loader concrete truck.

According to its major aspects and broadly stated, the present device is an accessory for improving and enhancing the function and purpose of the rubber boot and chute area of a ready mix concrete truck, and for increasing the safety, health, and environmental aspects of cleaning thereof, wherein (1) physical exertion and risk of injury to the truck operator is minimized and incidence of MSD's, restricted duty claims and lost time are reduced, (2) the quantity of water utilized for cleaning is reduced such that not only is water conserved, but the resulting cleaner safer work environment reduces the number of slips, trips and falls, lowering the incidence of strains, sprains, and tears, (3) the overall cleanliness of the truck is improved, and (4) the functional life span of the boot, chute, mechanical parts, and the truck itself is increased.

More specifically, the present device, according to the preferred embodiment, comprises a plurality of cables and a magnetic base, wherein the cables are attached, at a first end, proximate the peripheral edge of the rubber boot of the concrete truck chute, and wherein the second end of the cables are attached to the magnetic base. The magnetic base is adapted to be securely and removably positioned on metal components of the truck in order to facilitate easy access and manipulation of the cables, and thereby easy access and manipulation of the boot. In a first, at-rest position for the device, the magnetic base is positioned on the chute and the cables are extended such that the boot flaps are extended fully. Concrete is delivered from the truck with the device in the first position. Thereafter, the device is quickly, easily, and safely repositioned to a second in-use position, wherein the magnetic base is repositioned to a higher surface and re-secured to the truck, and whereby the cables are relatedly repositioned such that the ends of the concrete boot flaps are automatically pulled upward, effectively exposing the boot and surrounding area for cleaning With the boot flap ends secured in such manner, quick and efficient rinsing and cleaning of the chute, the boot, and mechanical elements and general area surrounding the boot and chute is facilitated, without necessitating risky bending and twisting movements by the truck operator.

According to an alternate embodiment, the device could be integrated with the boot. That is, the device could alternately be defined as an improved boot with on-board system for facilitating cleaning access, as well as other potential improvements, such as boot component structures or the like.

Thus, a feature and advantage of the present device is its ability to minimize risk of injury to a truck operator during cleaning of the truck.

Another feature and advantage of the present device is its ability to enable a worker to work in a more efficient manner, utilizing less water and reducing the amount of time and effort needed for the task of cleaning a concrete boot, chute, and truck, while coincidently introducing less water into the surrounding area, and thereby reducing the risk of slip and fall injury.

Another feature and advantage of the present device is that it is of simple design and operates with no need for power, fuel or any moving parts, thereby preventing the need for generation of exhaust or other fumes into the environment.

Yet another feature and advantage of the present device is its ability to decrease musculoskeletal risk factors for ready mix concrete truck drivers. Still another feature and advantage of the present device is that it encourages effective cleaning by ready mix concrete truck drivers, by minimizing risk of injury, as well as by facilitating ease of task.

Yet another feature and advantage of the present device is its ability to extend the functional life of a ready-mix concrete truck and the components thereof. Still another feature and advantage of the present device is its ability to render a chute boot easily accessible.

Yet still another feature and advantage of the present device is its ability to improve and enhance the function and purpose of the rubber boot and chute area for both front and rear loader concrete trucks.

Still yet another feature and advantage of the present device is its ability to facilitate maintenance of an overall cleaner vehicle and to thereby provide a safer and healthier work environment.

Yet another feature and advantage of the present invention is its ability to reduce the necessary incidence of bending, twisting, and stretching movements and thereby reducing incidence of back injuries, headaches, MSD's and other physical injuries commonly associated with ready mix concrete truck drivers, and also preventing inadvertent loss of personal articles down the chute.

Another feature and advantage of the present device is its ability to function without need for costly or complicated installation of equipment.

These and other objects, features and advantages of the present concrete discharge boot accessory device will become more apparent to one skilled in the art from the following description and claims when read in light of the accompanying drawings.

BRIEF DESCRIPTION OF THE DRAWINGS

The present device will be better understood by reading the Detailed Description of the Preferred and Alternate Embodiments with reference to the accompanying drawing figures, in which like reference numerals denote similar structure and refer to like elements throughout, and in which:

FIG. 2 is a partial, overhead view of a concrete discharge boot accessory device, according to the preferred embodiment of the present device, showing the device as installed proximate a discharge chute;

FIG. 3 is a partial, side view of a concrete discharge boot accessory device, according to the preferred embodiment of the present device, showing the magnetic base member and cable attachment;

DETAILED DESCRIPTION OF THE PREFERRED AND ALTERNATE EMBODIMENTS

In describing the preferred and alternate embodiments of the present device, as illustrated in the FIGS. 2-3 and 6-9, and/or described herein, specific terminology is employed for the sake of clarity. The device, however, is not intended to be limited to the specific terminology so selected, and it is to be understood that each specific element includes all technical equivalents that operate in a similar manner to accomplish similar functions.

Figure 1:
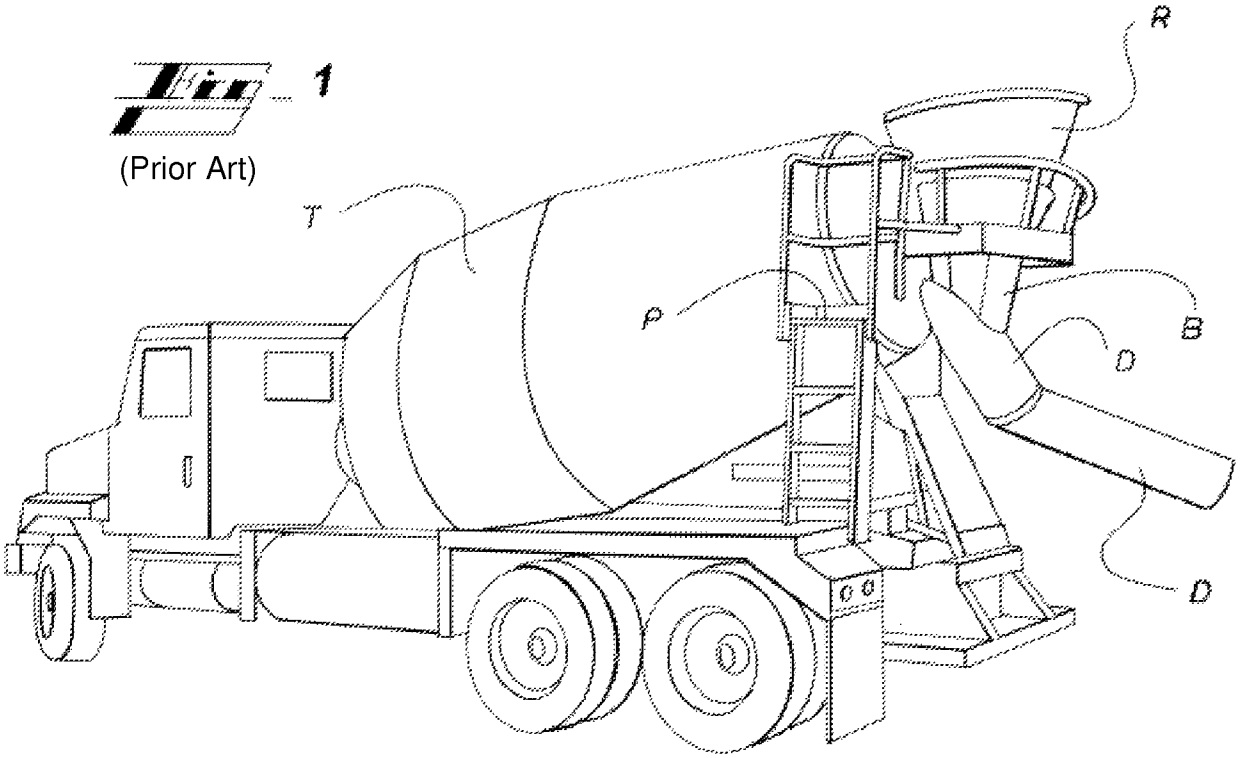
Fig. 1 (Prior Art)
FIG. 1 is a perspective view of a ready mix concrete truck, showing a rear discharge chute with rubber boot, drop chute, and access platform, as is known.
Figure 4:
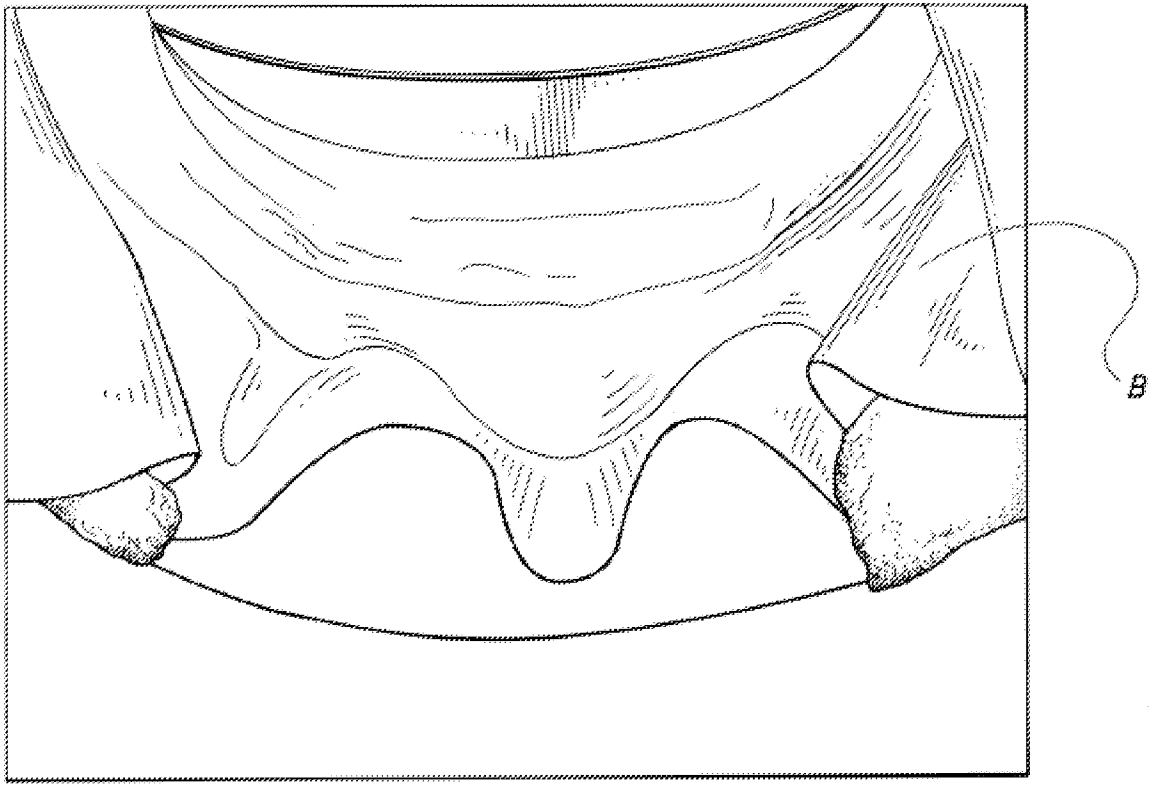
Fig. 4 (PRIOR ART)
FIG. 4 is a view of a dirty boot and a surrounding area, according to the prior art.
Figure 5:
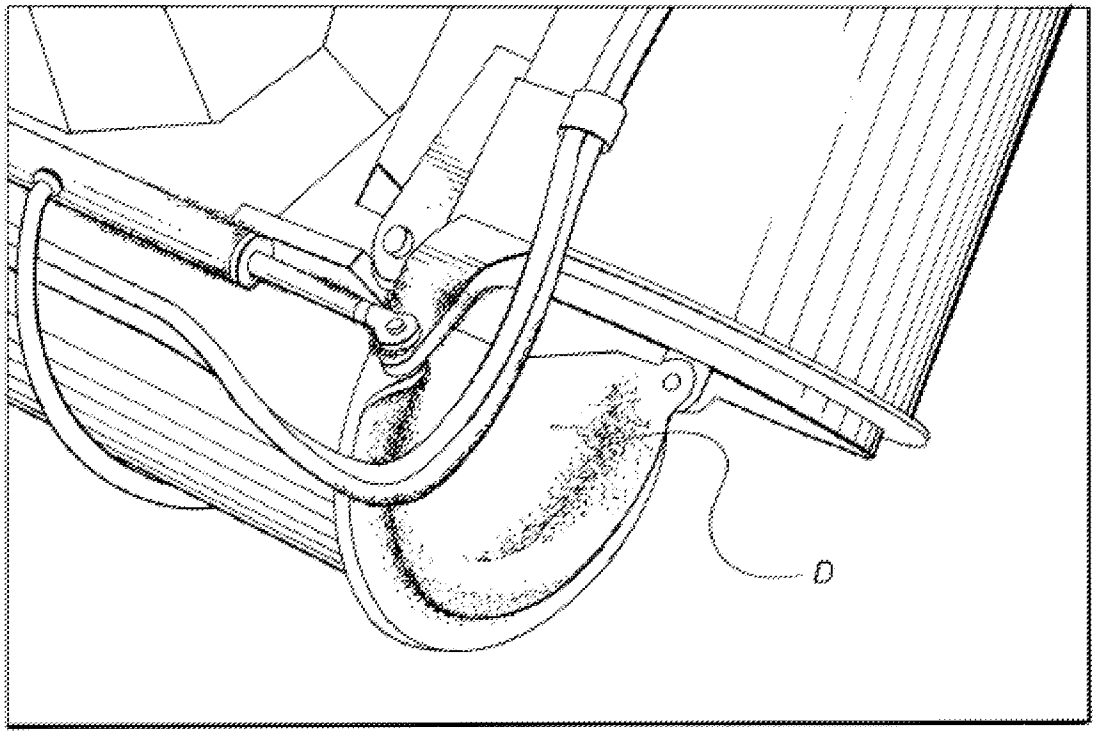
Fig. 5 (PRIOR ART)
FIG. 5 is a side view of an unclean discharge chute, according to the prior art.
Figure 6:
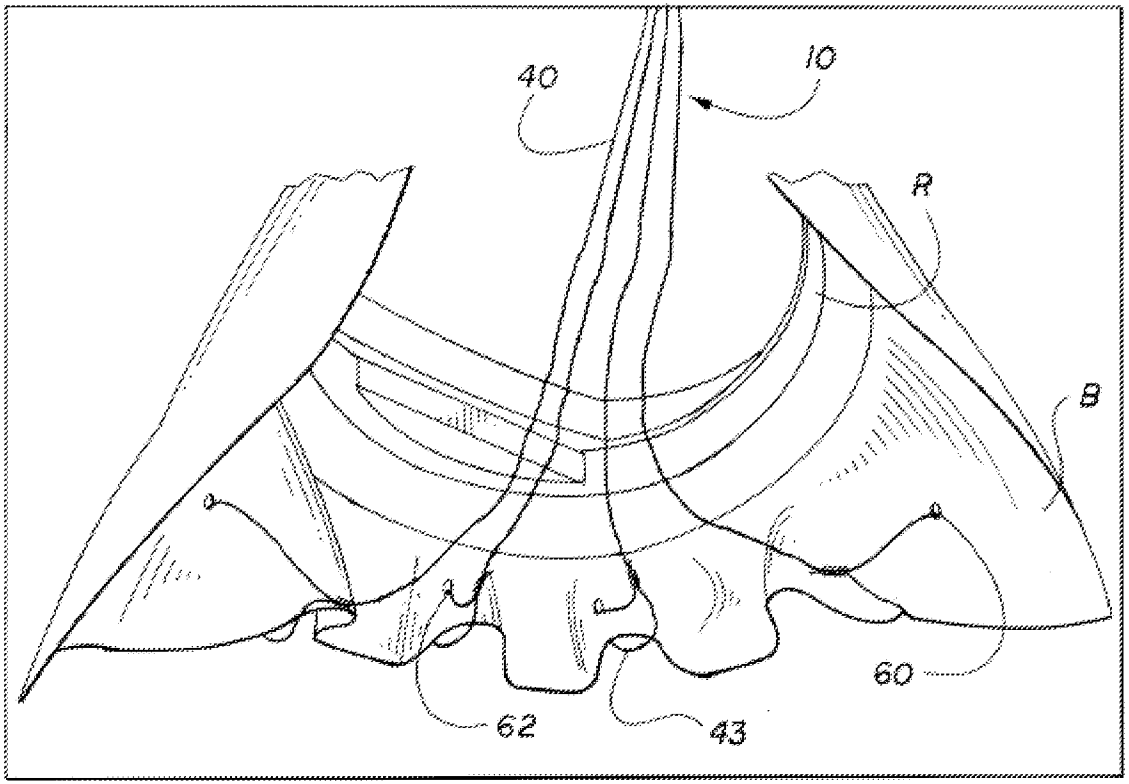
FIG. 6 is a view of a clean boot and a surrounding area, showing the cables of a concrete boot accessory device in an at-rest position, according to the preferred embodiment of the present device.
Figure 8:
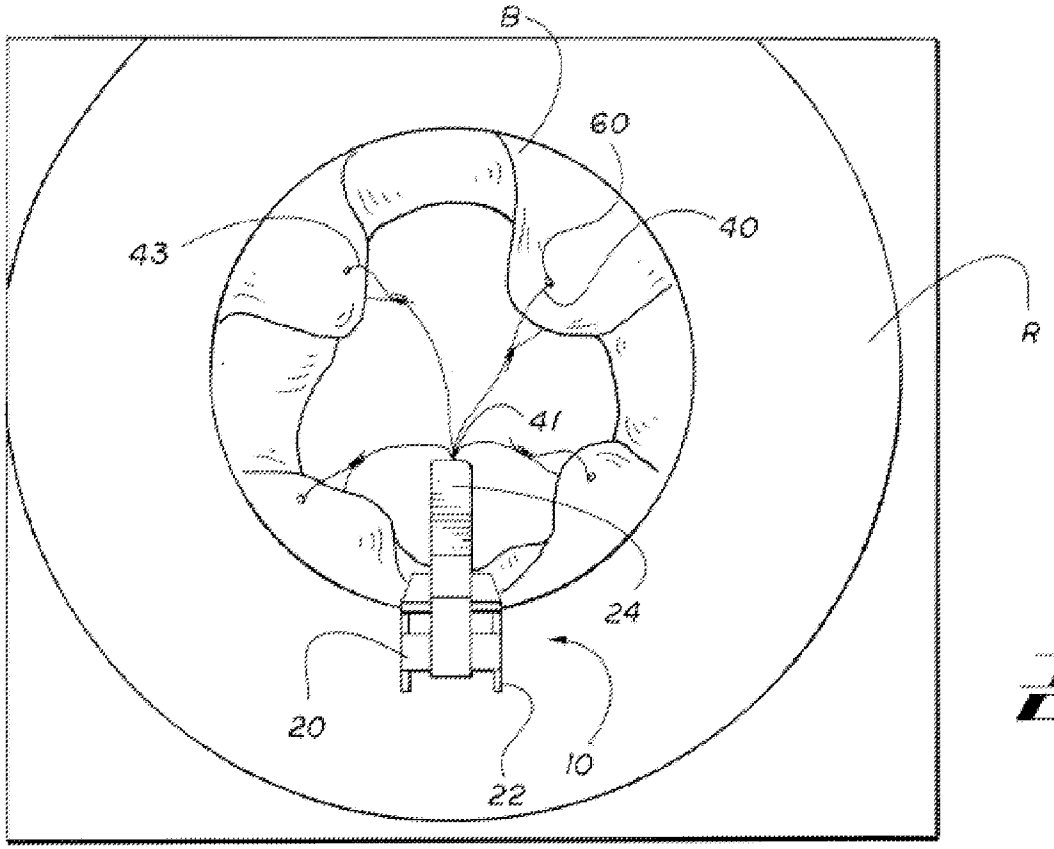
FIG. 8 is a view of the device, according to the preferred embodiment, showing the at-rest position.
Figure 9:
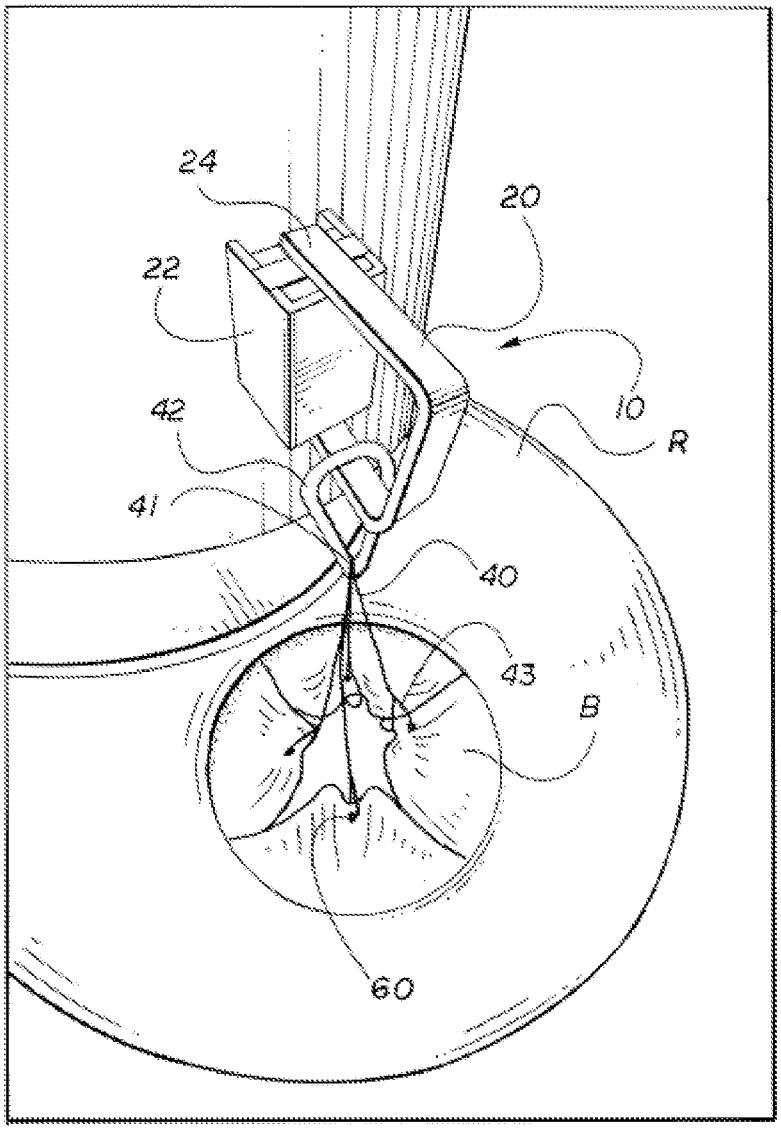
FIG. 9 is a view of the device, according to the preferred embodiment, showing the in-use position, with cables extended and boot drawn up.

Referring now to FIGS. 2 AND 9, the preferred embodiment is a concrete discharge boot accessory device 10, and method of use thereof, comprising cable carrier 20, plurality of cables 40, and boot connection means 60. Preferably, and with reference also to FIGS. 3 AND 8, cable carrier 20 is magnetic member 22 with handle 24, wherein magnetic member 22 is thus adapted for quick, easy and secure placement and repositioning on a metal surface of a concrete truck T, such as seen in FIGS. 1 AND 8-9. That is, cable carrier 20 is preferably adapted for removable positioning on drop chute R, or thereabove, as accessed from platform P, and proximate concrete discharge boot B, above discharge chute D.

Plurality of cables 40 are preferably attached at proximal end 41 to cable carrier 20 via connection means 42, wherein connection means 42 is preferably a lockable connector, such as a carabiner, in order to allow for flexibility of movement of plurality of cables 40 relative to cable carrier 20. Preferably, distal end 43 of plurality of cables 40 is attached to concrete discharge boot B, preferably proximate a peripheral edge thereof. According to the preferred embodiment, plurality of cables 40 are secured to boot connection means 60, preferably plurality of grommets 62, wherein each of the plurality of grommets 62 is positioned on a flap of concrete discharge boot B. As depicted in the preferred embodiment, concrete discharge boot B has four (4) flaps and it is therefore preferred that plurality of cables 40 and plurality of grommets 62 similarly and relatedly total four (4); however, it should be noted that any number of cables 40 could be utilized, either more or less than four (4), and whether or not equivalent to the number of flaps present in concrete discharge boot B.

Figure 7:
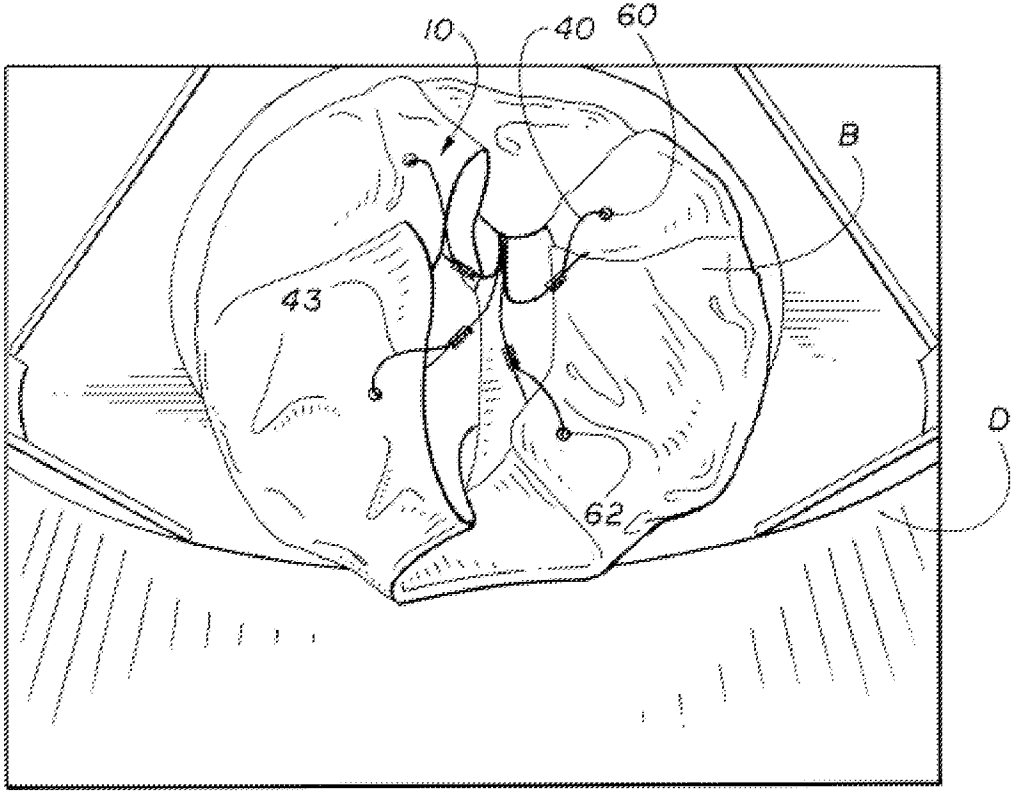
FIG. 7 is a view of a boot and a surrounding area, showing boot drawn up and the chute exposed, according to the preferred embodiment of the present device.

Referring again to FIGS. 2, 7 and 9, according to the preferred installation and method of use, concrete boot accessory device 10 is preferably installed to facilitate safe, efficient, and expeditious cleaning of truck T. As previously noted, concrete boot accessory device 10 is adapted for use on either a front or rear loader concrete truck, without any need for modification. Magnetic base 22 is adapted to be securely and removably positioned on metal components of truck T, in order to facilitate easy access and manipulation of plurality of cables 40, and thereby easy access and manipulation of boot B, wherein preferably, magnetic base 22 is secured to drop chute R during concrete delivery. In this first, at-rest position, as seen in FIG. 7, plurality of cables 40 are extended such that the flaps of boot B are extended fully and concrete delivery is efficiently and protectively directed therethrough.

Following completion of the delivery, concrete boot accessory device 10 may be quickly, easily, and safely repositioned to a second, in-use position, as seen in FIG. 8, wherein magnetic base 22 is repositioned to a higher surface, such as preferably proximate a sidewall above the hopper and re-secured to truck T. As a result of this repositioning of magnetic base 22, proximal ends 41 of plurality of cables 40 are relatedly repositioned, distal ends 43 of plurality of cables 40 are pulled upward relative to the position of discharge chute R, and the flaps of boot B are pulled upward by plurality of cables 40, effectively exposing boot B surfaces, as well as the surrounding area for cleaning With the secure placement of magnetic base 22 onto a selected surface of truck T, the flaps of boot B safely remain, hands-free, in exposed position as long as desired, enabling quick, efficient and safe rinsing and cleaning of dispensing chute D, boot B, and mechanical elements and general area there-surrounding.

With appreciation of the intended functionality of preferred concrete boot accessory device 10, one skilled in the art may readily envision alternate embodiments that are intended to be encompassed herein. For example, plurality of cables 40 could be manufactured from steel cabling, extruded plastic, rubberized strips, copper, string, rope, chain link, or any other material or combination of materials, whether rounded or flat, so long as suitably strong and resilient to allow for the intended functionality. In another alternate embodiment, plurality of cables 40 could be replaced with a plurality of fixed arm elements, hinged members, hydraulic members, or the like, whereby movement of boot B could be assisted in order to enhance cleaning there around. Also, plurality of cables 40 could be just one cable, with or without a divergent distal end capable of attaching to more than one flap. For example, a single cable version could be utilized for flaps having suitable interrelatedness such that rendering one flap accessible to cleaning would sequentially and effectively render all flaps accessible to cleaning.

Similarly, it should be recognized that boot connection means 60 may alternately be formed without plurality of grommets 62, wherein plurality of cables 40 could be integrally related to boot B, could be clipped or otherwise attached to boot B proximate the edges thereof, could be fastened via adhesive, threaded cable lock fasteners, magnets, or any other suitably strong hardware and/or manner of attachment. Also, boot connection means 60 could be attached a plurality of locations relative to boot B, essentially without limitation, wherein one or more than one of each plurality of cables 40 could be attached to one or more flaps of boot B.

Further, cable carrier 20 may be alternately configured, without handle 24, and with or without magnetic properties, wherein essentially any means of attachment to elected positions relative truck T may alternately be utilized, or even selected positions relative to the user, without attachment to truck T, wherein, although not as convenient, the user could simply hold cable carrier 20 during the cleaning process. Alternately, cable carrier 20 could be a clipable device, that could attach to available surface structures of truck T, or to relatedly installed dedicated structures intended to facilitate placement thereof, such as a receiving mount, cleat, ring, or the like. According to a further alternate, rubber boot accessory device 10 could be manufactured to include a pulley system on-board truck T, such that the user would simply activate the pulley system in order to retract plurality of cables 40. Also, an electronic system could be introduced, such that retraction of cables 40 could be essentially and/or partially automated.

Finally, connection means 42 of cable carrier 20 could be any suitable connector capable of securing plurality of cables 40 to cable carrier 20, or rubber boot accessory device 10 could be manufacture without connection means 42, for example, if plurality of cables 40 were directly connected to or integrally formed with cable carrier 20.

Also, a plurality of connection means 42 could be utilized, imparting desired independence to plurality of cables 40, if desired.

As noted hereinabove, device 10 could be integrated with the boot. That is, device 10 could alternately be defined as an improved boot with on-board system for facilitating cleaning access, as well as other potential improvements, such as boot component structures or the like.

For example, boot component structures could be improved with a stronger, longer lasting material of manufacture than presently available gum rubber materials, such as, for exemplary purposes only, cloth-inserted sheets, rubber sheets, neoprene, nitrile, EPDM, silicone, santoprene, or other appropriate material. Additionally, boot component elements or sheets could be alternately shaped and/or sized, with varied thickness to enhance functionality of device 10 and/or the boot itself.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed as new and what is desired to secure by Letters Patent of the United States is:

1. A combined ready mix concrete truck and a combined concrete discharge boot and concrete discharge boot accessory device, comprising:

a ready mix concrete truck including a drop chute and an access platform positioned adjacent to said drop chute, and a rear discharge chute situated subjacent to said drop chute;

a concrete discharge boot having an inlet and an outlet capable of receiving and discharging concrete, said inlet being attached to a distal end of said drop chute, said outlet being attached to a proximal end of said rear discharge chute, wherein said concrete discharge boot is intercalated between said drop chute and said rear discharge chute;

a concrete discharge boot accessory device including a plurality of support members;

a carrier attached to said ready mix concrete truck and located above said concrete discharge boot, said carrier being engaged with a proximal end of said plurality of support members; and means for connecting a distal end of said plurality of support members to a distal end of said concrete discharge boot, said distal end of said support members being located proximate to said outlet of said concrete discharge boot;

wherein said carrier cooperates with said plurality of support members and said means for connecting said distal end of said plurality of support members to said distal end of said concrete discharge boot and thereby selectively displaces said distal end of said concrete discharge boot between raised and lowered positions, relative to said outlet of said concrete discharge boot, thereby enabling access to an underside of said distal end of said concrete discharge boot without having to remove said concrete discharge boot from said ready mix concrete truck during cleaning procedures;

wherein said concrete discharge boot includes a plurality of flaps, wherein said flaps are flexible and oscillate along said distal end of said concrete discharge boot.

2. The device of claim 1, wherein said carrier is a member with a handle and a magnetic surface.

3. The device of claim 1, wherein said plurality of support members is selected from the group including steel cabling, extruded plastic, rubberized strips, copper, string, rope, or chain link.

4. The device of claim 1, wherein said carrier is a clipable device.

5. The device of claim 1, wherein said carrier is a pulley system.

6. The device of claim 5, wherein said carrier is an electronic system operationally linked to at least partially retract said plurality of support members.

* * * * *